United States Patent [19]

Meckler

[11] 4,276,817

[45] Jul. 7, 1981

[54] AIR BAR ASSEMBLY

[76] Inventor: Gershon Meckler, 7425 Democracy Blvd. Unit 212, Bethesda, Md. 20034

[21] Appl. No.: 62,870

[22] Filed: Aug. 1, 1979

Related U.S. Application Data

[60] Continuation of Ser. No. 959,634, Nov. 13, 1978, which is a continuation of Ser. No. 829,939, Sep. 1, 1977, which is a continuation of Ser. No. 741,092, Nov. 11, 1976, which is a continuation of Ser. No. 489,745, Jul. 18, 1974, which is a division of Ser. No. 308,180, Nov. 20, 1972, Pat. No. 3,828,180.

[51] Int. Cl.[3] ..... F24F 13/04

[52] U.S. Cl. ..... 98/38 E; 98/40 D; 137/896

[58] Field of Search ..... 98/40 D, 38 E, 40 C; 137/604

[56] References Cited

U.S. PATENT DOCUMENTS

| | | | |
|---|---|---|---|
| 3,265,859 | 8/1966 | Castello et al. | 98/38 E X |
| 3,382,916 | 5/1968 | Laux | 98/38 E X |
| 3,611,908 | 10/1971 | Spoormaker | 98/40 D X |
| 3,748,998 | 7/1973 | Lambert | 98/40 D |

*Primary Examiner*—William E. Tapolcai, Jr.
*Attorney, Agent, or Firm*—John C. Purdue

[57] ABSTRACT

A lighting fixture is disclosed. The lighting fixture comprises a top and side and end walls, means for supporting a light source in the fixture to emit light from a light-emitting side thereof, and conduit means operatively associated with the fixture so that a heat transfer fluid circulated therethrough is in heat transfer relationship with the fixture. The fixture has a path including at least one opening therein through which air can flow from the exterior on the light-emitting side to the interior, and to the exterior opposite the light-emitting side, and a damper movable between an open position and a closed position, and effective in the closed position, but ineffective in the open position, to prevent the flow of air from the interior of the fixture to the exterior opposite the light-emitting side. The fixture also includes means responsive to the temperature of the lighting fixture, and effective to move the damper toward an open position when the fixture temperature exceeds a control temperature, and to move the damper toward a closed position when the fixture temperature is below a control temperature.

3 Claims, 6 Drawing Figures

AIR BAR ASSEMBLY

REFERENCE TO RELATED APPLICATIONS

This is a continuation of application Ser. No. 959,634, filed Nov. 13, 1978 as a continuation of application Ser. No. 829,939, filed Sept. 1, 1977, in turn a continuation of application Ser. No. 741,092, filed Nov. 11, 1976 as a continuation of application Ser. No. 489,745, filed July 18, 1974, in turn a division of application Ser. No. 308,170, filed Nov. 20, 1972, now U.S. Pat. No. 3,828,180.

BACKGROUND OF THE INVENTION

Lighting fixtures having conduit means for the circulation of a heat transfer fluid in heat transfer relationship with the fixture have been suggested, U.S. Pat. No. 3,424,233, and offer significant advantages in air conditioning systems. A substantial amount of heat energy is necessarily released from lights within an air conditioned building. This heat energy is at a comparatively high level, so that a major portion thereof can be absorbed by lighting fixtures associated with light sources, and transferred to a circulated liquid heat transfer fluid at a comparatively high temperature. Under cooling conditions, the comparatively high temperature heat transfer fluid can be circulated to a heat exchanger, usually of the indirect type, and the energy absorbed thereto can be discharged from the air conditioning system without the necessity for the use of refrigeration. In addition, it is frequently necessary at any given time to remove heat from one zone of a building that is air conditioned and, at the same time, to add heat to another zone of the same building. Lighting fixtures which include means for transferring the heat energy necessarily associated with lighting to a circulated heat transfer fluid are admirably suited for use in the control of air conditioning systems to meet the changing needs of different zones of a building for addition and removal of heat.

By way of example, the circulating system which supplies a heat transfer fluid to lighting fixtures of the indicated type for a given zone of an air conditioned building can be controlled in response to a temperature sensor which measures instantaneous need of a particular zone of the building for addition or removal of heat to open a suitable valve to enable circulation of the heat transfer fluid when heat removal is required, and to close that valve when addition of heat to the zone in question is necessary to maintain a comfort condition. Such a control system is disclosed in U.S. Pat. No. 3,401,742. A zone temperature control system of this particular type is especially effective if air is circulated from the zone in question to absorb heat from the lighting fixture or fixtures serving that zone when heating is required, and the heated air is then returned to the zone.

It has been found, however, that the light output of a given lighting fixture varies as a function of the temperature at which the light source therein operates. As a consequence of this variation, controlling the circulation of heat transfer fluid to lighting fixtures serving a building zone for the purpose of controlling the temperature of that zone, causes variations in the lighting intensity of those lighting fixtures. In general, an increase in the temperature at which a light source operates causes a decrease in lighting intensity. Periodic variations in the lighting output of fixtures is undesirable.

BRIEF DESCRIPTION OF THE INVENTION

The instant invention is based upon the discovery of a lighting fixture wherein the circulation of a heat transfer fluid can be controlled to absorb, or not to absorb, as required from time to time, heat energy from lights within a building to control temperature in various zones of the building, and wherein the temperature of the light source and, consequently, the light output thereof, is maintained substantially constant. A lighting fixture according to the instant invention comprises a top and side and end walls, means for supporting a light source in the fixture to emit light from a light-emitting side thereof, and conduit means operatively associated wth the fixture so that a heat transfer fluid circulated therethrough is in heat transfer relationship with the fixture. The lighting fixture according to the invention has a path including at least one opening therein through which air can flow from the exterior on the light emitting side to the interior, and to the exterior opposite the light emitting side, and a damper to control air flow through the opening. The damper is movable between an open position and a closed position, and is effective, in the closed position, but ineffective in the open position, to prevent the flow of air from the interior of the fixture to the exterior opposite the light-emitting side. The fixture also includes means responsive to the temperature thereof, and effective to move the damper toward an open position when the fixture temperature exceeds a control temperature, and to move the damper toward a closed position when the fixture temperature is below a control temperature.

It is an object of the invention to provide an improved lighting fixture.

It is a further object of the invention to provide an improved lighting fixture which includes conduit means operatively associated therewith so that a heat transfer fluid circulated therethrough is in heat exchange relationship with the fixture, there being a path including at least one opening in the fixture through which air can flow from the exterior on the light-emitting side to the interior and to the exterior opposite the light-emitting side, and a damper closing the opening when the temperature of the fixture is below a control temperature, and opening the damper when the temperature is above a control temperature.

DETAILED DESCRIPTION OF THE INVENTION

Figure 1:
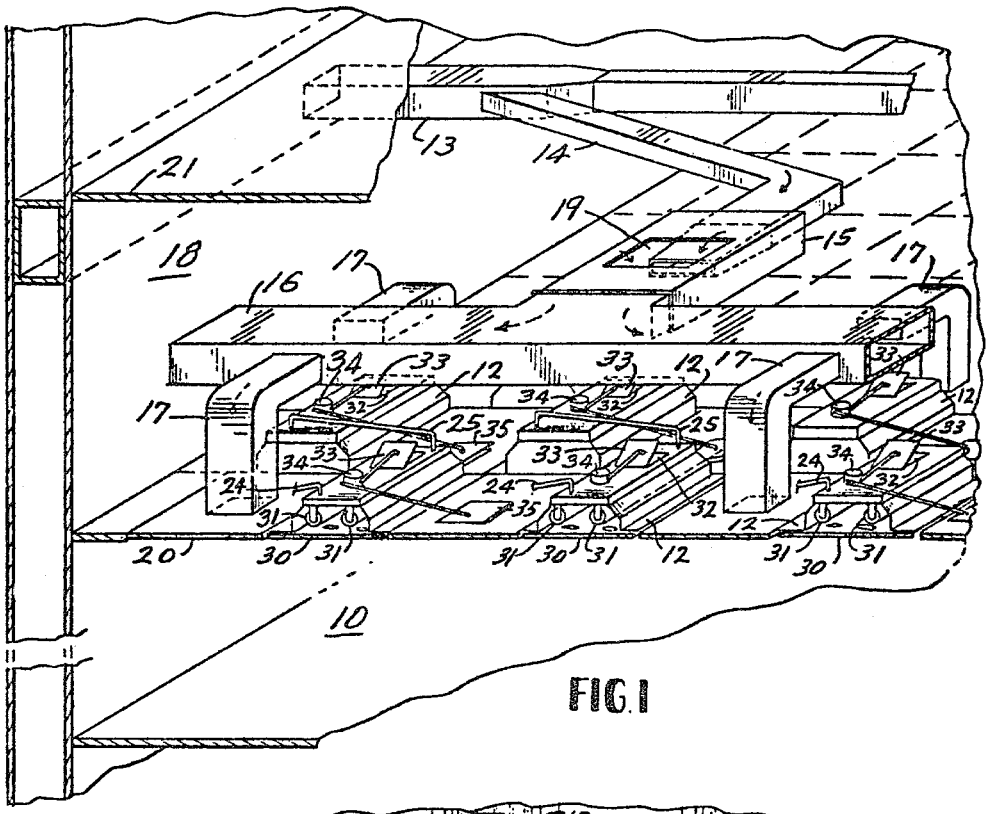
FIG. 1 is a partially schematic sectional view in perspective showing a plurality of lighting fixtures according to the invention mounted as part of an air conditioning system.

Referring to FIG. 1, an air conditioning system for a zone 10 of a building 11 is shown. The system includes a plurality of lighting fixtures 12 and an air supply system including a duct 13 through which primary conditioned air from a source (not illustrated) is circulated through a duct 14 to a mixing box 15. Air from the mixing box 15 flows through a supply header 16 and ducts 17 to the zone 10 of the building 11. The mixing box 15 has an interior orifice (not illustrated), so that air flowing into the mixing box 15 from the duct 14 induces a flow of air from a plenum 18, through an opening 19, and into the mixing box 15 where it is mixed with primary air from the duct 14 for delivery to the zone 10 through the ducts 17. The plenum 18 is between a ceiling 20 for the zone 10 and a floor 21, thereabove.

Figure 2:
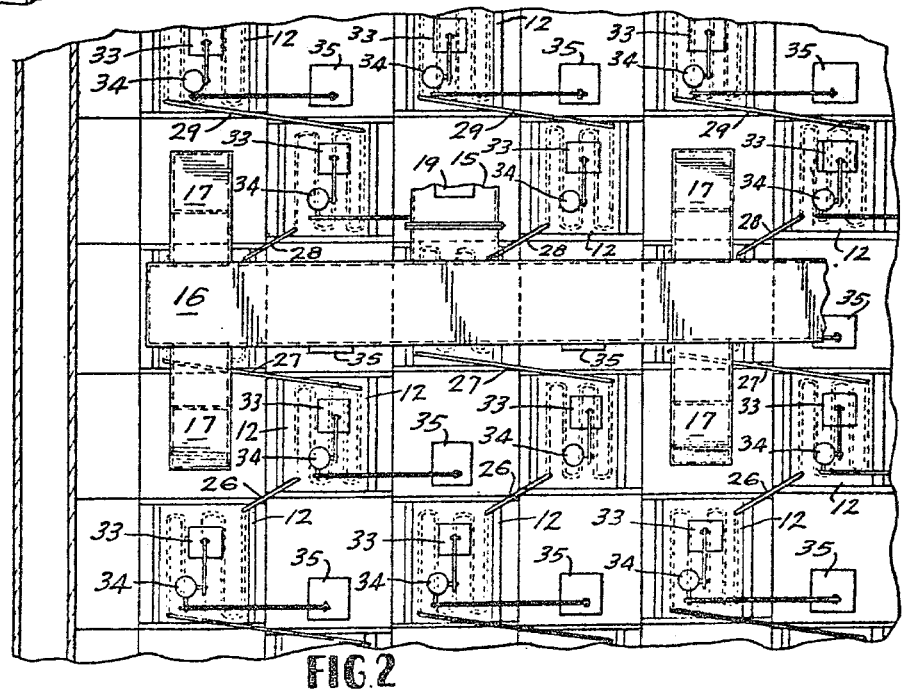
FIG. 2 is a sectional plan view showing further details of the air conditioning system of FIG. 1, and including lighting fixtures according to the invention.

Referring to FIG. 2, the lighting fixtures 12 have coils 22, which can be copper tubes brazed to tops 23 of the fixtures, or can be conduits formed integrally with the tops 23, through which a heat transfer fluid is circulated, as required, to remove heat from the fixtures 12. Referring again to FIG. 1, the heat transfer fluid flows from a source (not illustrated) through feeders 24 into first ones in a series of fixtures 12. After circulation through the coils 22 of the first fixtures in the series, the heat transfer fluid flows through lines 25 to second ones of the fixtures 12, from thence through lines 26 to the third one of the fixtures 12 (see FIG. 2), through lines 27 to fourth ones of the fixtures 12, lines 28 to fifth ones of the fixtures 12 and lines 29 to sixth ones of the fixtures 12. Heat transfer fluid from the coils 22 of the sixth ones of the fixtures 12 is returned to an equipment room (not illustrated) where heat is transferred therefrom, as required, to maintain a control temperature of, say 70° F. The heat transfer fluid is then returned through a circulating system (not illustrated) to the feeders 24.

Referring again to FIG. 1, the lighting fixtures 12 are mounted flush with the ceiling 20, and have open, grid-type diffusers 30 through which light from sources 31 is emitted to the zone 10. The fixtures 12 also have openings 32 through which air can flow from the zone 10 of the building 11 into the plenum 18, except when the openings 32 are blocked by dampers 33. In FIG. 1, the dampers 33 are all shown in open position, a position which they assume, in the air conditioning system shown, when it is necesary to add heat to the primary air delivered to the mixing box 15 through the duct 14. The need to add heat to the primary air can be sensed by a thermostat (not illustrated) in the zone 10, which then throttles, by suitable means (not illustrated) the flow of heat transfer fluid through the lines 24 to the first ones of the fixtures 12. The throttling of the flow of heat transfer fluid causes the body temperatue of each of the fixtures 12 to increase; this is sensed by thermostat-controllers 34 which, in response to the sensing of a temperature above a control temperature, move the dampers 33 to the open positions shown. When the dampers 33 are open, there is a flow of air from the zone 10 of the building 11 through the lighting fixtures 12 and the openings 32 into the plenum 18, and from the plenum 18 through the opening 19 into the mixing box 15 where it is mixed with primary air from the duct 14, and from which the mixture is ultimately returned through the ducts 17 to the zone 10. By way of example, the air conditioning system of FIGS. 1 and 2 can have one lighting fixture 12 for every 50 square feet of floor space in the zone 10, and a mixture of primary and recirculated air can be delivered through the ducts 17 at a rate of 0.6 cubic foot per minute per square foot of floor space in the zone 10, the mixture being made up of 0.3 cubic foot per minute per square foot of primary conditioned air from the duct 14 and 0.3 cubic foot per minute per square foot of floor space from the plenum 18. Under these conditions, when the dampers 33 are in the open position shown in FIG. 1, there is a flow of 30 cubic feet per minute of air through each of the openings 32; this air, flowing through the fixtures 12 picks up approximately 375 Btu's per hour per fixtures. As a consequence of this flow of air from the zone 10 through the fixtures 12, the plenum temperature under this mode of operation is about 87° F. when the temperature of the zone 10 is 75° F.

When the air conditioning system of FIGS. 1 and 2 is operating as just described, and a thermostat (not illustrated) senses a temperature above a control temperature, for example 76° F., valves (not illustrated) are opened to enable a heat transfer fluid to flow through the lines 24 and into the first ones of the fixtures 12, flow being in series through six of the fixtures 12, as previously described, in the system shown. For example, water can be supplied at about 70° F. and at a rate of about 15 cubic feet per minute to each of the lines 24. When the fixtures are of such a size that the total energy input to each is substantially 500 Btu's per minute, 70° F. water flowing at 15 cubic feet per minute will leave the sixth of the fixtures at about 76° F., and the total heat transfer from the fixtures 12 is substantially the same as when no water was flowing, but air from the zone 10 circulated through the fixtures 12 and into the plenum 18, as previously described. The circulation of water through the fixtures 12, for example as described, lowers the body temperature of each of the fixtures, which temperature is sensed by the thermostat-controllers 34; when the sensed temperature is lower than a control temperature, each of the thermostat-controllers 34 closes its associated damper 33. Three-fourths of the thermostat-controllers 34 are of the dual acting type, and are operatively connected to dampers 35 which cover grilled openings (not illustrated) from the zone 10 into the plenum 18; these thermostat-controllers 34 not only close the dampers 33 but also open the associated dampers 35 to enable air flow from the zone 10 into the plenum 18 for mixing in the box 15 with primary air. When the system of FIGS. 1 and 2 is operating as just described, the plenum temperature is about 77° F.

The lighting output of the light sources 31, which are illustrated as fluorescent tubes, is temperature dependent. Accordingly, throttling the flow of water to water cooled lighting fixures for zonal temperature control, as suggested by the prior art, has resulted in undesirable variations in lighting intensity. The fixtures 12 of the instant invention, when used as a part of an air conditioning system as described, provide substantially constant lighting intensity because substantially the same amount of the heat is transferred from each of the fixtures, whether the system is operating on reheat, with the water throttled, or on maximum cooling, with full water flow.

Figure 3:
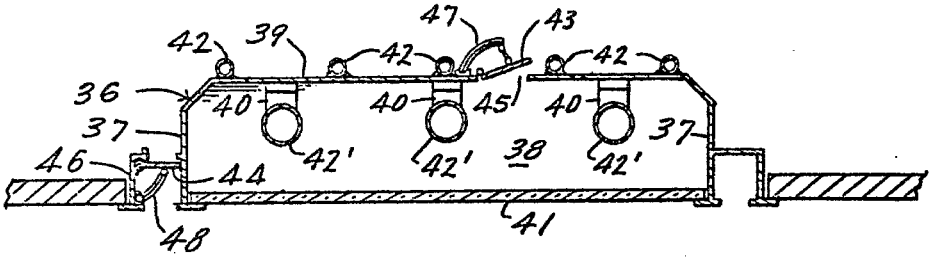
FIG. 3 is a sectional view showing another lighting fixture according to the invention including two dampers thermostatically controlled in opposition.

Referring to FIG. 3, a lighting fixture 36 is shown. The fixture 36 comprises side walls 37, end walls 38, a top 39, light supports 40, and a lens 41. Light sources 42 are shown carried by the supports 40. Like the fixture 12 of FIGS. 1 and 2, the fixture 36 of FIG. 3 has tubes 42 brazed or otherwise attached thereto, and in heat transfer relationship therewith. The fixture 36 also has dampers 43 and 44, which, as subsequently described, are thermostatically controlled in opposition. The damper 43 is pivotally mounted in the top of the fixture 36, and is shown in the open position so that air can flow through an opening 45 on the fixture. The damper 44 is pivotally mounted in a flange 46 to control air flow through the opening in the flange 46 from a building space below the fixture 36 and into a plenum thereabove and therearound. The damper positions shown in FIG. 3 are those when thermostat-contollers 47 and 48 for the dampers 43 and 44, respectively, sense a body temperature or interior temperature for the fixture 36 above a control temperature. When the thermostat controllers 47 and 48, which are bimetallic elements, sense a fixture temperature below a control temperature the positions of the dampers 43 and 44 are reversed, the former being closed and the latter being opened. In this damper position air can flow from a space below the fixture 36 through the opening in the flange 46, but a flow of air from the interior of the fixture 36 through the opening 45 is prevented because the damper 43 is closed.

Figure 4:
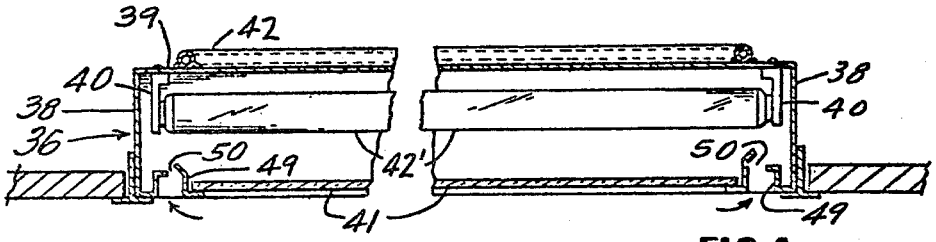
FIG. 4 is a longitudinal elevational view with parts broken away to show details of construction of the lighting fixture of FIG. 3.

Referring to FIG. 4, the lighting fixture 36 has end channel members 49 which are generally of inverted U-shaped with openings 50 therethrough. When the damper 43 is in the open position because the thermostat controller 47 senses a temperature above a control temperature, air is free to flow through the openings 50 into the interior of the fixture 36 and from thence through the opening 45 to the exterior of the fixture 36, for example into the plenum 18 when the fixture 36 is substituted for the fixture 12 in the air conditioning system of FIGS. 1 and 2.

Figure 5:
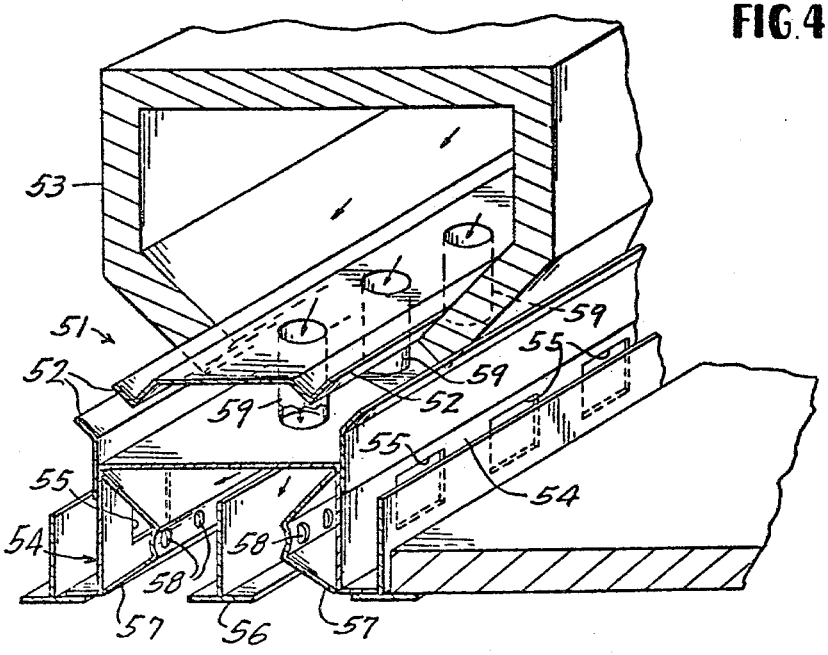
FIG. 5 is a perspective view showing a modified duct which can be used to deliver a mixture of primary and recirculated air in the air conditioning system of FIG. 1.

Referring to FIG. 5, an air bar 51 which can be used to replace the mixing box 15, the supply header 16 and ducts 17 of the air conditioning system of FIGS. 1 and 2 is shown. The air bar 51 has generally parallel arms 52 which extend upwardly and outwardly to receive and support a glass fiber insulating duct 53. The duct 53 can advantageously carry an exterior metal cover, for example of aluminum foil. Two of the supports 52 are carried by a channel member 54 which is generally of U-shape, and which has longitudinally spaced openings 55 in the side walls thereof. Mounted interiorally of the channel member 54 are a T-member 56 and reentrant V-members 57. The V-members 57 have openings 58 extending longitudinally thereof. The web of the channel member 54 carries a plurality of nozzles 59, spaced longitudinally thereof, and positioned to deliver air from the duct 53 to the interior of the channel member 54. When air under pressure, for example primary air for an air conditioning system is introduced into the interior of the air bar 51, there is a flow of the air through the nozzles 59 to the interior of the channel member 54. This air flows downwardly into a restricted region between the reentrant V-members 57, and is then directed laterally in two streams flowing generally in opposite directions by the T-member 56. As a consequence of the air velocity caused by the nozzles 59 a flow of air through the openings 58 and 55 for mixture with air leaving the channel member 54 is induced. It will be appreciated that when the air bar 51 is operatively connected in the air conditioning system of FIGS. 1 and 2 with the duct 14, and in place of the mixing box 15, the header 16 and the ducts 17, the air bar 51 of FIG. 5 delivers supply air which is a mixture of primary air from the duct 14 and secondary air from the plenum 18 (FIG. 1) to the zone 10 of the building 11. As a consequence of the operation of the heat transfer fluid system serving the fixtures 12, and of the dampers 33 and 35, as discussed in connection with FIGS. 1 and 2, the mixture of primary air and plenum air delivered by the air bar 51 maintains a desired comfort condition in the zone 10.

It will be appreciated that the heat transfer fluid circulating system described above with reference to FIGS. 1 and 2 is not essential to the operation of the system, as other suitably controlled means can be used to transfer heat from the lighting fixture 12 to a heat sink. For example, at least one heat pipe, one end of which is in thermal contact with the lighting fixtures 12 and the other end of which is in thermal contact with a heat sink which could be a heat transfer fluid system, a flow of relief air, a suitably energized thermoelectric circuit, or the like can be used to transfer heat as required from the fixtures 12, and suitably deactivated whenever heat from the fixtures 12 is required because the temperature of the zone 10 is below a control temperature.

Air bars similar to the air bar 51 of FIG. 5, but without the nozzles 59 to induce a flow of plenum air for mixture with primary air and delivery to a zone or room of a building have heretofore been suggested. Such air bars, however, have not found acceptance in many air conditioning systems, for example for office buildings, and for at least two reasons: (1) the difficulty of maintaining effective zone control over temperature with variations in the air conditioning load and (2) the need for high air flows, in terms of cubic feet of air per minute, per square foot of floor space, to provide adequate air circulation for comfort. As discussed above, the air bar 51, when used as part of a system, as described, provides the required zone control over temperatures. In addition, the air bar 51 provides the required high rate of discharge, without the necessity for delivering primary conditioned air at a rate sufficiently high to provide such discharge rate. Instead, in the air bar 51, the air discharged is a mixture of primary conditioned air and of air induced, for example from a plenum through the openings 55 and 58 by the action of the nozzles 59. Since the induced air can approximately equal the flow of primary air, the air bar 51 can provide a comfort condition when primary conditioned air at a suitably lower temperature, dew point or both, is supplied thereto at approximately half the rate required in previously known air bars. This minimizes the need for air handling equipment to furnish primary conditioned air to the air bar 51, and, therefore, substantially reduces one of the problems that had previously mitigated against the use of air bars in air conditioning systems of office buildings and the like.

Figure 6:
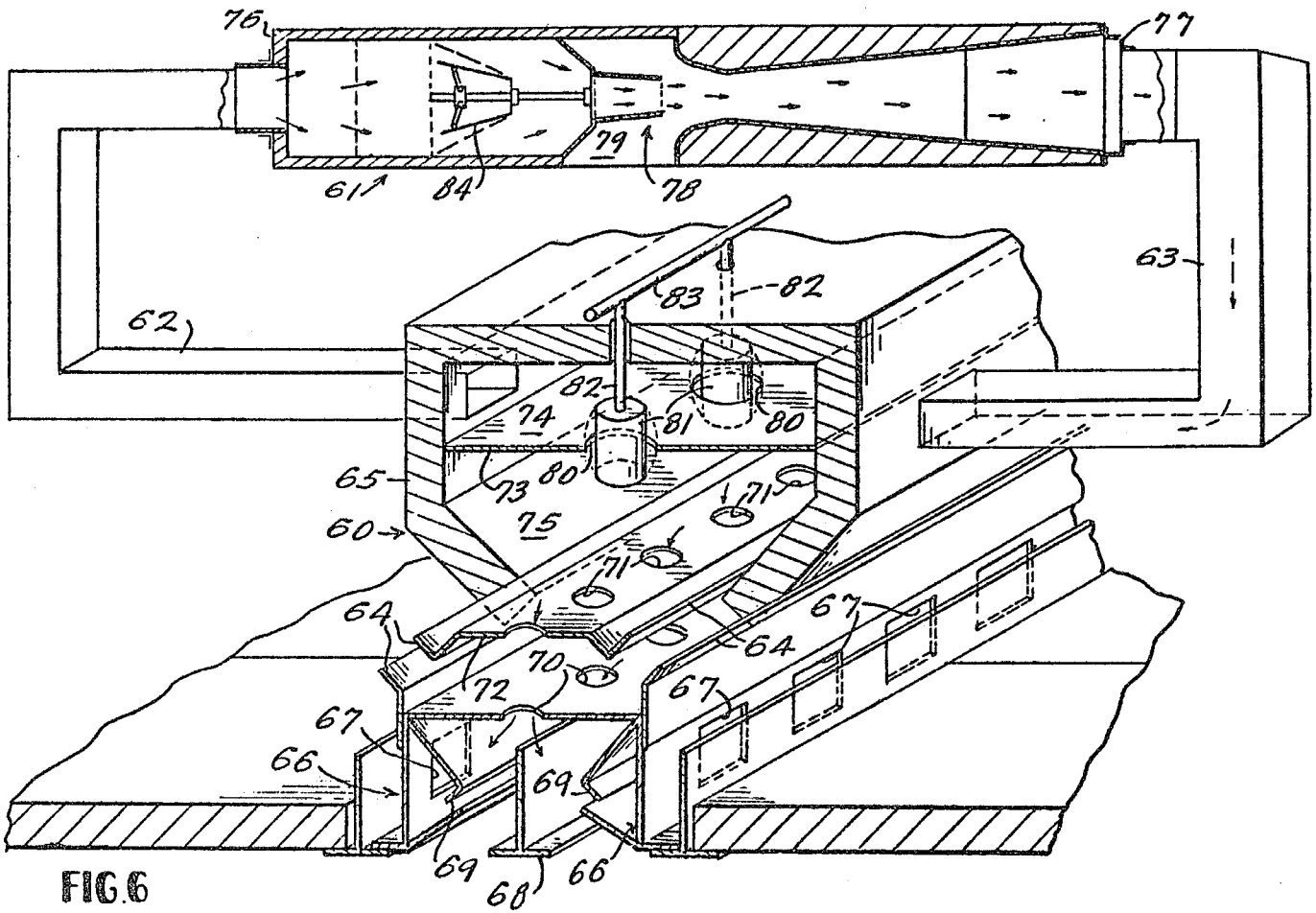
FIG. 6 is a perspective view showing a combined duct and induction box which can be used to deliver a mixture of primary and recirculated air in the air conditioning system of FIG. 1.

Referring to FIG. 6, an assembly comprising an air bar indicated generally at 60, a mixing box indicated generally at 61, and ducts 62 and 63 is shown. The assembly of FIG. 6 can be used to provide all the advantages described above over previously known air bars and, in addition, can provide even greater zone control over temperature, when installed as a part of an appropriate air conditioning system. The air bar 60 has generally parallel arms 64 which extend upwardly and outwardly to receive and support a glass fiber insulating duct 65. Two of the supports 52 are carried by a channel member 66 which is of generally U-shape, and which has longitudinally spaced openings 67 in the sidewalls thereof. Mounted interiorly of the channel member 66 are a T-member 68 and reentrant V-members 69. The web of the channel 66 has a plurality of openings 70, spaced longitudinally thereof. The openings 70 are generally aligned with openings 71 in a web 72 which connects the upper ones of the arms 64. The air bar 60 also has a divider 73, which extends longitudinally thereof, generally parallel to the web of the channel 66. The divider 73 divides the duct 65 into a primary duct 74, which is spaced from the web of the channel 66, and a secondary duct 75, which is adjacent the web of the channel 66.

The duct 62 is operatively associated with the duct 65, and positioned to receive air from the primary duct 74, and to deliver that air to an inlet end 76 of the induction box 61. Air delivered to the inlet end 76 of the induction box 61 flows therethrough in the direction indicated by the arrows to an outlet end 77 of the induction box 61, and from thence through the duct 63 back to the secondry duct 75 of the duct 65. In flowing through the induction box 61, as described, air passes through nozzles positioned generally at 78, so that air flow is induced through an opening 79, for mixture with air from the nozzles, and return therewith through the duct 63 to the secondary duct 75.

It will be appreciated that, when the assembly of FIG. 6 is installed as part of an air conditioning system operated, for example, as described above in connection with the system of FIGS. 1 and 2, and the induced air flowing into the system through the opening 79 is plenum air, the FIG. 6 apparatus provides both zone control over temperature and adequate discharge from the air bar 60 to provide a comfort condition, without the necessity for delivering large quantities of primary conditioned air to the air bar 60.

The air bar 60 also has openings 80 in the divider 73 through which air can flow directly from the primary duct 74 into the secondary duct 75. An expansible valve member 81 is mounted by a compressed air line 82, which is operatively connected to a compressed air header 83 in each of the openings 80 of the divider 73. When the air conditioning load in a zone served by the combination of FIG. 6 is below a control point, compressed air can be delivered from the header 83, through the lines 82 to expand the valves 81 and, as a consequence, to prevent flow of air from the primary duct 74 through the openings 80 into the secondary duct 75. So long as the valves 81 are inflated to prevent air flow through the openings 80, space temperature can be controlled by modulating the flow of water through lighting fixtures (not illustrated in FIG. 6) to control plenum temperature and, as a consequence, the temperature of air induced through the opening 79 and of the mixture of such induced air and primary air delivered through the duct 63. Such modulation can be controlled as described above in connection with FIGS. 1 and 2.

The mixing box 61 includes a constant volume valve 84 positioned between the inlet end 76 and the location 78 of the induction nozzles. The constant volume valve 84 is advantageously of the mechanical type, for example loaded by a spring or by a weight, so that the valve opens, i.e., moves from the solid line position shown in FIG. 6 in the direction of the dotted line position, and closes, respectively, in response to increases and decreases in the pressure at the inlet end 76 of the induction box 61. When the constant volume valve 84 is of this type, a substantially constant flow of air is provided in the duct 63, in the secondary duct 75, and from the air bar 60 to a space served thereby.

In an air conditioning system of the type disclosed in FIGS. 1 and 2, and described in connection therewith, it is particularly advantageous to use control apparatus which monitors temperature in both a room or zone served by a particular portion of the apparatus and the temperature of the plenum thereabove, which uses the temperature sensed in the room or zone to determine the set temperature for the plenum, and which controls the circulation of water through the lighting fixtures 12 to cause the plenum temperature to approach the set temperature for the plenum. For example, the system might be designed to maintain a room temperature of 75° F., and operating with full water flow through the fixtures 12 to maintain this temperature in an interior conference room occupied by a large number of persons attending a meeting. When the conference room is vacated, after the meeting, there is a sudden and substantial drop in the need for air conditioning. The first indication that would be sensed by the control system briefly described above would be a drop in temperature. When this temperature reached, say 73° F., this would cause a signal which would change the set temperature for the portion of the plenum serving the conference room to, say, 85° F. Since the sensed plenum temperature would then be approximately 75° F., the flow of water through the relevant ones of the fixtures 12 would be stopped in response to a sensed temperature lower than the temperature set in response to the signal from the room thermostat. In the illustrative situation just described, the immediate change in water flow through the fixtures is highly desirable, because there has been a substantial decrease in load on the air conditioning system in the conference room. However, should the temperature sensed in the conference room reach 73° F. as a consequence of only a small change in air conditioning load, the system described will equally well accommodate that changed condition, because water will be circulated by the control system through the lighting fixtures 12 to maintain the 85° F. plenum temperature. On the other hand, when a new meeting convenes in the conference room, there is then a sudden increase in the air conditioning load, and the temperature sensed therein can be expected to increase to, say, 77° F. When this occurs, a signal from the control system resets the set point with respect to plenum temperature to, say, 77° F. and, since the plenum temperature sensed is above this, full flow of water through the fixtures 12 is commenced, and continued until the plenum temperature reaches a new set temperature.

I claim:

1. Air delivery apparatus comprising, in combination, an air bar assembly and an induction box, said air bar assembly comprising an air delivery section including an elongate channel having a web and opposed sidewalls, there being a plurality of longitudinally spaced openings in the web of said channel, means operatively associated with said channel and effective in combination therewith to form a duct having the web of said channel as one wall, the duct being essentially closed except for the openings in the web of said channel, a divider interior of and effective to divide the duct into a primary duct spaced from the web of said channel and a secondary duct adjacent the web of said channel, there being a plurality of openings in said divider through which air can flow between the primary and secondary duct, and valve means for controlling the flow of air through the openings in said divider, said induction box having means forming a passage for air flow from an inlet end to an outlet end, and at least one induction nozzle through which air flowing through the passage passes, there being an opening from the exterior of said induction box to the interior thereof, which opening is so positioned that air flowing through said induction nozzle induces a flow of air into said induction box, a duct for delivering air from the primary duct of said air bar assembly to the inlet end of said induction box, and a duct for delivering air from the outlet end of said induction box to the secondary duct of said air bar.

2. Air delivery apparatus comprising, in combination, an air bar assembly and an induction box, said air bar assembly comprising an air delivery section including an elongate channel having a web and opposed sidewalls, there being a plurality of longitudinally spaced openings in the web of said channel, means operatively associated with said channel and effective in combination therewith to form a duct having the web of said channel as one wall, the duct being essentially closed except for the openings in the web of said channel, and a divider interior of and effective to divide the duct into a primary duct spaced from the web of said channel and a secondary duct adjacent the web of said channel, said induction box having means forming a passage for air flow from an inlet end to an outlet end, and at least one induction nozzle through which air flowing through the passage passes, there being an opening from the exterior of said induction box to the interior thereof, which opening is so positioned that air flowing through said induction nozzle induces a flow of air into said induction box, a duct for delivering air from the primary duct of said air bar assembly to the inlet end of said induction box, and a duct for delivering air from the outlet end of said induction box to the secondary duct of said air bar.

3. Air delivery apparatus comprising, in combination, an air bar assembly, an induction box and a primary duct for deliverying conditioned air to the apparatus, said air bar assembly comprising an air delivery section including an elongate channel having a web and opposed sidewalls, there being a plurality of longitudinally spaced openings in the web of said channel, means operatively associated with said channel and effective in combination therewith to form a duct having the web of said channel as one wall, the duct being essentially closed except for the openings in the web of said channel, said induction box having means forming a passage for air flow from an inlet end to an outlet end, and at least one inductor, there being an opening from the exterior of said induction box to the interior thereof, which opening is so positioned that the inductor induces a flow of air into said induction box for mixture therein with conditioned air, a duct for delivering conditioned air from said primary duct to the inlet end of said induction box, and a duct for delivering a mixture of conditioned air and induced air from the outlet end of said induction box to the duct of said air bar.

* * * * *